US006106346A

United States Patent [19]

Bolen

[11] Patent Number: 6,106,346

[45] Date of Patent: Aug. 22, 2000

[54] STABILIZING FIN FOR A WATER PLANING DEVICE

[76] Inventor: Robert Bolen, 1818 Pine St., Huntington Beach, Calif. 92648

[21] Appl. No.: 09/098,400

[22] Filed: Jun. 17, 1998

[51] Int. Cl.[7] ..... B63B 1/00

[52] U.S. Cl. ..... 441/79; 114/39.15

[58] Field of Search ..... 114/39.12, 39.15, 114/39.24, 127, 140, 126; 441/74, 79

[56] References Cited

U.S. PATENT DOCUMENTS

| | | | |
|---|---|---|---|
| 3,089,157 | 5/1963 | May | 9/310 |
| 3,103,673 | 9/1963 | Martin | 441/79 |

FOREIGN PATENT DOCUMENTS

| | | | |
|---|---|---|---|
| 2502108 | 9/1982 | France . | |
| 2576867 | 8/1986 | France | 114/127 |
| 3509229 A1 | 9/1986 | Germany . | |
| 1382736 A1 | 3/1988 | U.S.S.R. . | |

*Primary Examiner*—Stephen Avila

*Attorney, Agent, or Firm*—Knobbe Martens Olsen & Bear, LLP.

[57] ABSTRACT

The stabilizing fin includes an upper vertical stabilizer element, a hollow tubular element, and a lower vertical stabilizer element. The upper vertical stabilizer element has an upper end for attachment to a bottom surface of a water planing device. The hollow tubular element has an upper portion depending from a lower end of the upper vertical stabilizer element. The tubular element has an open front end and an open rear end. The lower vertical stabilizer element has an upper end depending from a lower portion of the hollow tubular element. During use thereof the upper and lower vertical stabilizer elements provide lateral stability and the hollow tubular element provides increased lateral stability and vertical stability for enhanced control by a user. The water planing device maybe, for example, a surfboard or a wind surfing board.

10 Claims, 3 Drawing Sheets

FIG. 8
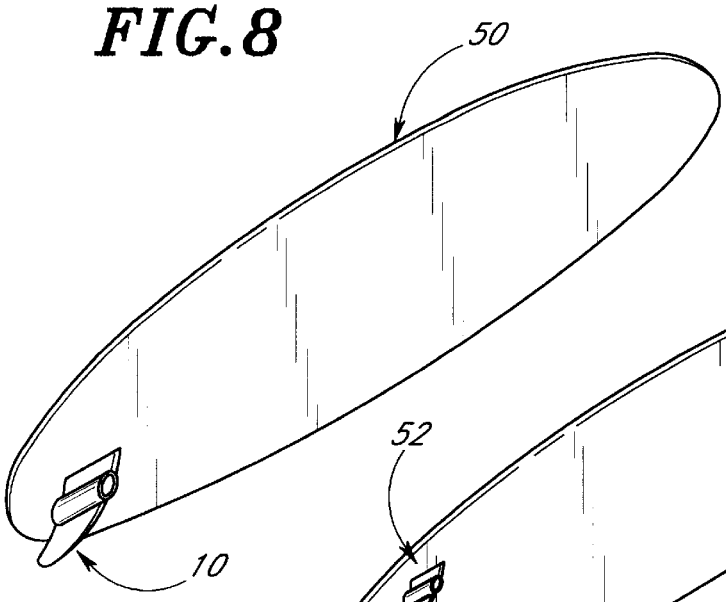
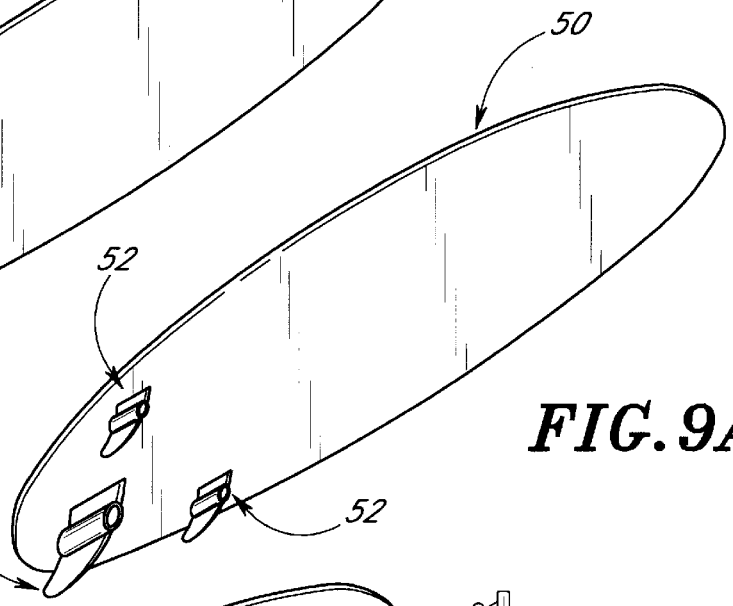
FIG. 9A
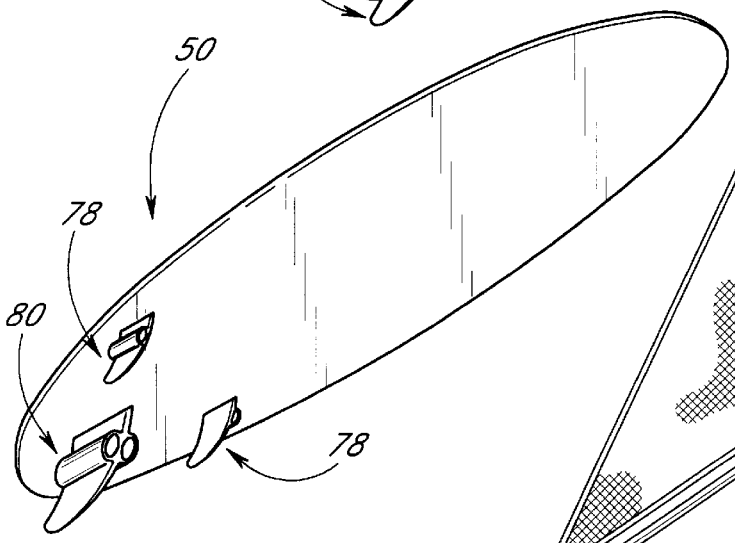
FIG. 9B
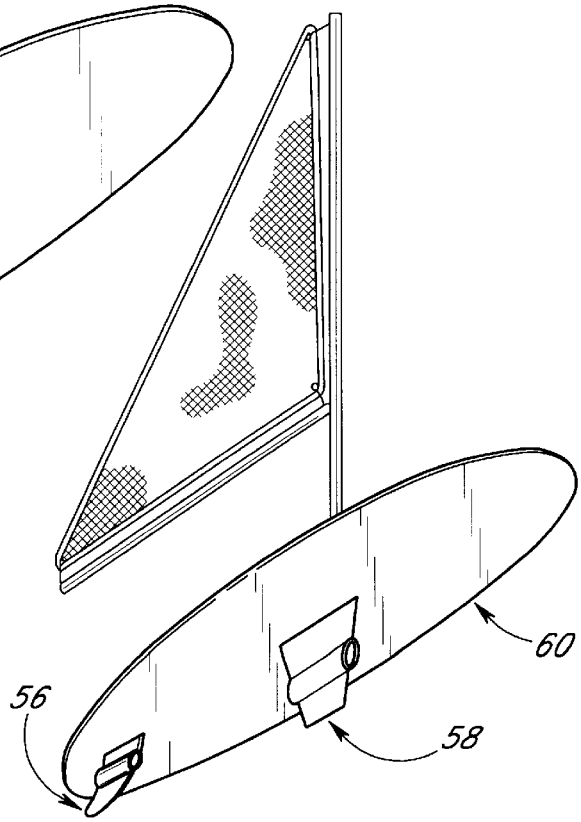
FIG. 10

STABILIZING FIN FOR A WATER PLANING DEVICE

BACKGROUND OF THE INVENTION

1. Field of the Invention

The present invention relates to stabilizing fins for water planing devices such as surfboards or wind surfing boards and more particularly to a stabilizing fin which provides enhanced lateral and vertical stability.

2. Description of the Related Art

Commonly used surfboards and wind surfing boards utilize one or more "shark-like" fins which may extend vertically up to 16 inches below the bottom surface of the surfboard or wind surfing board. This type of fin generally only allows for the stabilization of a surfboard or wind surfing board in the horizontal direction while riding through the water or on a wave under either smooth or rough water conditions. It offers little or no resistance to the vertical rise experienced while performing the various maneuvers common to either a surfboard or a wind surfing board. Any maneuver that moves the weight forward and causes the surfboard or wind surfing board to rise vertically may result in loss of control due to the fin losing contact with the wave or the water and result in a wipe out. Additionally as a wave becomes steeper, as it prepares to break, this type of fin, having only vertical design, will tend to lose contact with the face of the wave causing the loss of horizontal control allowing the board to slide sideways and cause a wipe out.

A patent search has revealed the following references:

U.S. Pat. No. 3,089,157, issued to G. H. May, discloses a fin for a water ski which is generally U-shaped in cross section.

German Patent No. DE3509-229-A, discloses a fin for boats or surfboards which has front and/or rear double guide fins spaced from a main fin.

French Patent No. FR2502-108, discloses a stabilizer for a sailing boat hull which is an open ended cylinder replacing keel, with sliding supports raised and lowered to vary inclination.

Soviet Union Patent No. SU1382736A1, discloses a keel for a sailing ship which has a fixed casing on the keel's streamlined hull with channels. A moving casing is attached to the fixed one by axles. The moving casing's upper edges enter grooves in the fixed casing's lower edges. Cables attached to the moving casing's ends pass through the channels.

OBJECTS AND SUMMARY OF THE INVENTION

It is therefore a principal object of the present invention to increase both the vertical and the horizontal control of a water planing device such as a surfboard or a wind surfing board under various water conditions, without adversely affecting the speed and/or the maneuverability of the water planing device.

These and other objects are achieved by the present invention which is a stabilizing fin for a water planing device. The stabilizing fin includes an upper vertical stabilizer element, a hollow tubular element, and a lower vertical stabilizer element. The upper vertical stabilizer element has an upper end for attachment to a bottom surface of a water planing device. The hollow tubular element has an upper portion depending from a lower end of the upper vertical stabilizer element. The tubular element has an open front end and an open rear end. The lower vertical stabilizer element has an upper end depending from a lower portion of the hollow tubular element. During use thereof the upper and lower vertical stabilizer elements provide lateral stability and the hollow tubular element provides increased lateral stability and vertical stability for enhanced control by a user. The water planing device maybe, for example, a surfboard or a wind surfing board.

The stabilizing fin stabilizes the water planing device in a variety of directions under a variety of conditions. For example, this invention gives the rider longer more controlled rides while performing on the nose area of a surfboard by holding the tail section down in the water. This invention gives the rider of the surfboard or a wind surfing board more control while riding through, in, or over the white water sections of waves while performing a variety of maneuvers. It gives the rider more control while riding on water or up or down face of a step wave on either a surfboard or a wind surfing board during either rough or smooth conditions.

Other objects, advantages, and novel features will become apparent from the following detailed description of the invention when considered in conjunction with the accompanying drawings.

BRIEF DESCRIPTION OF THE DRAWINGS

FIG. 8 is a perspective view of a surfboard with the stabilizing fin of the present invention attached thereto.

FIG. 9 illustrates a surfboard with an alternative arrangement of stabilizing fins of the present invention.

FIG. 10 illustrates use of the stabilizing fins of the present invention on a wind surfing board.

The same reference characters designate the same parts or elements throughout the drawings.

DETAILED DESCRIPTION OF THE PREFERRED EMBODIMENTS

Figure 1:
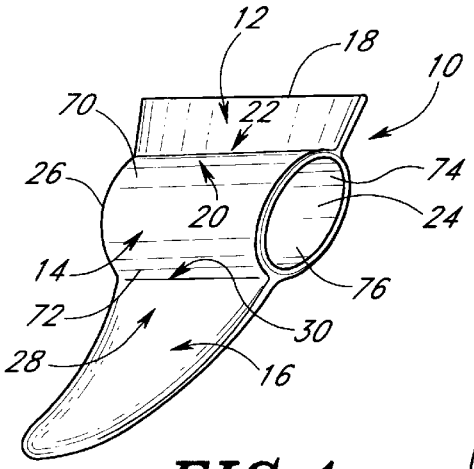
FIG. 1 is a front, side perspective view of the stabilizing fin of the present invention.
Figure 2:
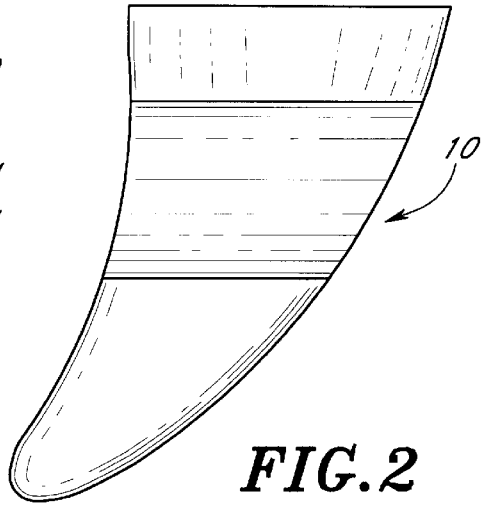
FIG. 2 is a side perspective view of the stabilizing fin.

Referring now to the drawings and the characters of reference marked thereon, FIGS. 1–7 illustrate a first embodiment of the present invention, designated generally as 10. Stabilizing fin 10 includes an upper vertical stabilizer element 12, a hollow tubular element 14 and a lower vertical stabilizer element 16. The upper vertical stabilizer element is generally shaped as a single vertically oriented plate. It has an upper end 18 which attaches to a bottom surface of a water planing device (not shown). It maybe attached by means well known in the art (either permanently affixed or removable).

The hollow tubular element 14 has an upper portion 20 which depends from a lower end 22 of the upper vertical stabilizer element 12. The tubular element, 14 has an open front end 24 and an open rear end 26.

Figure 4:
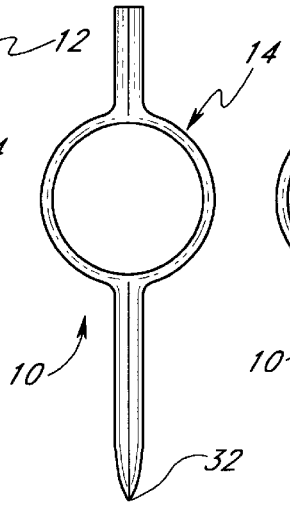
FIG. 4 is a rear end view of this embodiment.
Figure 5:
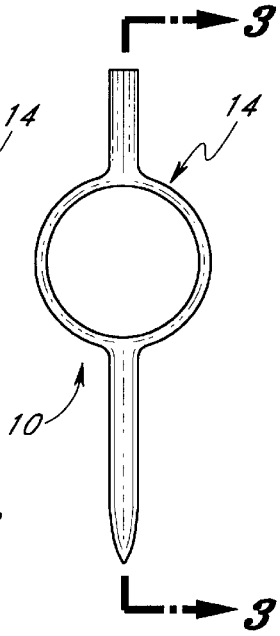
FIG. 5 is a front end view, taken along line 3—3 of FIG. 3.
Figure 6:
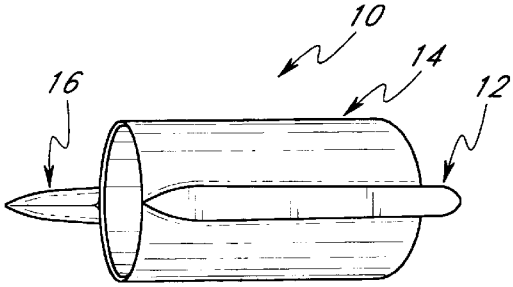
FIG. 6 is a top rear perspective view of the stabilizing fin.
Figure 7:
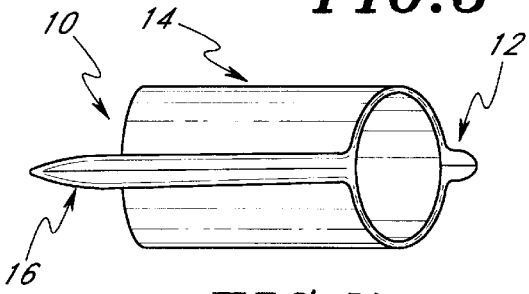
FIG. 7 is a bottom, front perspective view of the stabilizing fin.

As can be seen in FIGS. 4 and 5, the hollow tubular element 14 is symmetrical about its center line. In this preferred embodiment, the hollow tubular element 14 has a substantially circular cross-section.

The lower vertical stabilizer element 16 has an upper end 28 depending from a lower portion 30 of the hollow tubular element 14. The upper vertical stabilizer element 12, the hollow tubular element 14 and the lower vertical stabilizer element 16 are preferably integrally connected. They may be formed of typical surfboard fin materials such as fiberglass, injection-molded plastic, and carbon fiber composites. The combination of shapes required by the stabilizing fin 10 particularly lend themselves to recent advances in carbon composite manufacturing processes.

The front end of the hollow tubular element 14 preferably has a rounded leading edge and the rear end thereof preferably has a tapered trailing edge. Similarly, as can be seen in FIGS. 4 and 5, the upper vertical stabilizer element 12 and the lower vertical stabilizer element 16 have rounded leading edges and tapered trailing edges. The edges of the lower vertical stabilizer element 16 converge at a lower end 32 thereof.

Figure 3:
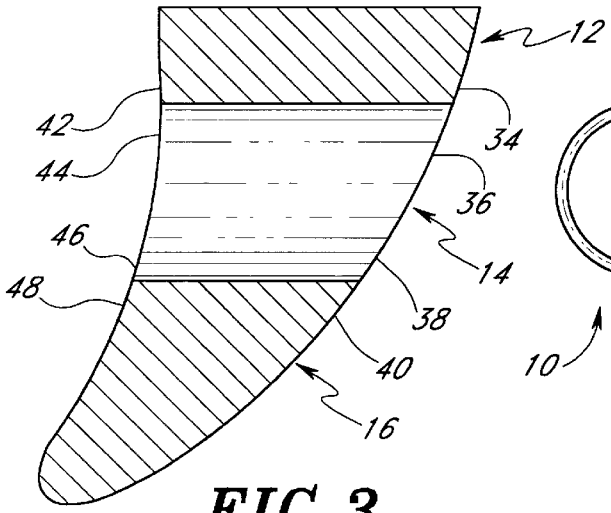
FIG. 3 is a cross sectional view of the stabilizing fin of FIGS. 1 and 2.

As can be seen, for example in FIG. 3, a lower front portion 34 of the upper vertical stabilizer element 12 is contiguous with an upper front potion 36 of the hollow tubular element 14. A lower front portion 38 from the hollow tubular element 14 is contiguous with an upper front portion 40 of the lower vertical stabilizer element 16. Furthermore, a lower rear portion 42 of the upper vertical stabilizer element 12 is contiguous with an upper rear portion 44 of the hollow tubular element 14. A lower rear portion 46 of the hollow tubular element 14 is contiguous with an upper rear portion 48 of the lower vertical stabilizer element 16. Thus, as can be seen in for example in FIG. 3, a continuous curve side profile is provided.

For a surfboard, the distance from the top of the upper vertical stabilizer element 12 to the bottom of the lower vertical stabilizer element 16 may typically be around 3 inches to about 12 inches. For a wind surfing board this distance may be up to about 15 inches.

The upper vertical stabilizer element 12 may have a width on the order of about 4 inches to 6 inches.

The lower vertical stabilizer element 16 may have a width that tapers from about 3 inches at the upper end down to the tip or perhaps as much as say about 6 inches down to the tip.

The hollow tubular element 14 may have a diameter of about 1 inch to about 3 inches for applications with a surfboard. This diameter may be substantially increased for applications on a wind surfing board.

Referring now to FIG. 8, application of the stabilizing fin 10 of the present invention is illustrated on a typical application on a surfboard 50.

FIG. 9 shows an alternate arrangement of the stabilizing fin on a surfboard 50. In this instance, two relatively small stabilizing fins 52 are positioned side-by-side forward a relatively large fin 54 near the back of the surfboard 50. This fin configuration provides an enhanced stabilizing effect on relatively large steep waves. As noted above, the stabilizing fins maybe permanently affixed to the board or removable and adjustable to, for examples, the configuration shown in FIG. 9.

FIG. 10 shows implementation of stabilizing fins, 56, 58 on a wind surfing board 60. Stabilizing fin 58 is attached near the center of the wind surfing board. Stabilizing fin 56 is attached near the rear of the board. This arrangement is shown by way of example. Obviously, there are many different configurations of stabilizing fins in accordance with the conditions.

Figure 11:
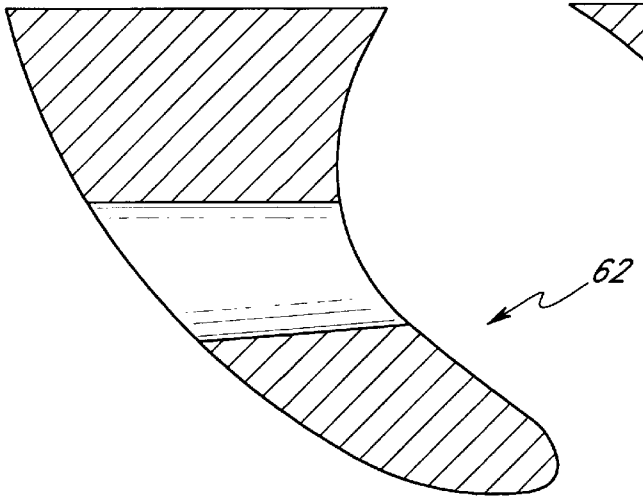
FIG. 11 is a cross sectional view of an alternative stabilizing fin in accordance with the principals of the present invention, which is more greatly swept back than the FIG. 1 embodiment.

FIG. 11 shows a stabilizing fin 62 with a fin profile which is swept back to a greater degree than the FIG. 1–7 embodiment. This is useful for creating a more drawn out turn. Additionally, this fin is more suitable for surfing in areas with an abundance of kelp, seaweed and rocks.

Figure 12:
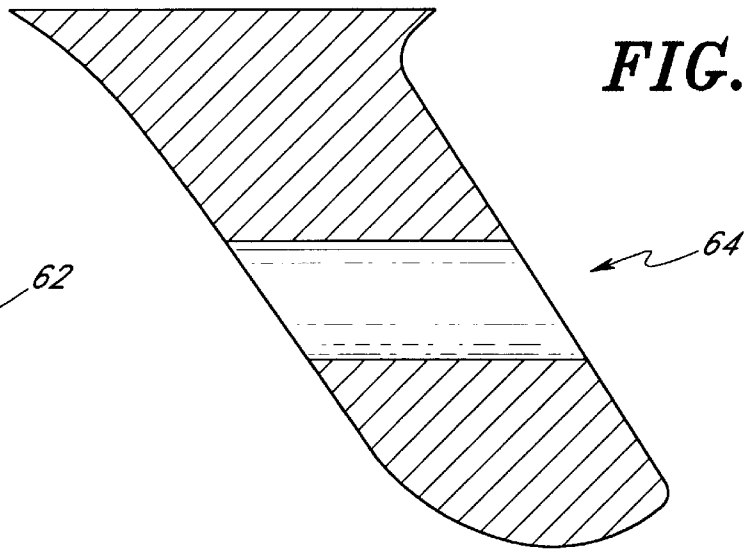
FIG. 12 is a cross sectional view of another fin profile which is more vertically oriented than the FIG. 1 embodiment.

FIG. 12 illustrates a stabilizing fin 64 with a fin profile which is more vertical than the other embodiment to create more of a pivot turn.

Figures 13, 14:
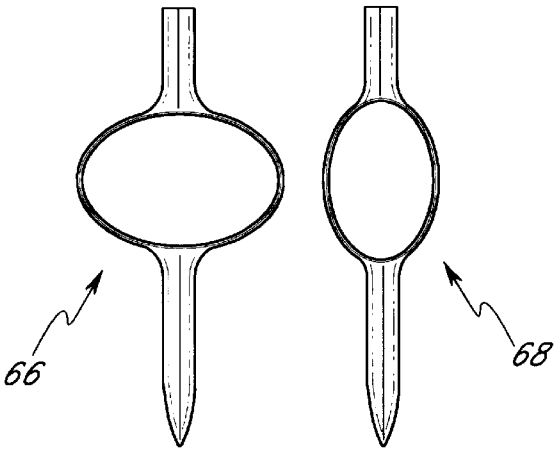
FIG. 13 is a rear end view of yet another embodiment which has a hollow tubular element with an elliptical shape.
FIG. 14 is a rear end view of another embodiment where the elliptical tubular element is oriented 90 degrees from the FIG. 13 embodiment.

Although the hollow tubular element 14 has been shown with a generally circular cross section it may have other shapes although these other shapes should be symmetrical about the center line to provide the best stability. For example, referring now to FIG. 13, a fin 66 is shown with an elliptical hollow tubular element. FIG. 14 shows another "elliptical " embodiment, designated generally as 68, with the ellipse oriented in another position.

The hollow tubular element in all these instances may serve as a device for connecting the surfboard to a rack or other permanent fixture for locking purposes.

The hollow tubular element provides an increased wetted surface area of the fin. The continuous water flow around and through the increased wetted surface areas of the stabilizing fin allow for more control of surfboards and wind surfing boards in all directions (both vertical and horizontal components) while the operator is directing the surfboard or wind surfing board through the water or up and down the face of the wave.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

I claim:

1. A stabilizing fin for a water planing device, comprising:

an upper vertical stabilizer element having an upper end for attachment to a bottom surface of a water planing device;

a hollow tubular element having an upper portion depending from a lower end of said upper vertical stabilizer element, said tubular element having an open front end and an open rear end, wherein said front end of said hollow tubular element comprises a rounded leading edge and wherein said rear end of said hollow tubular element comprises a tapered trailing edge; and a lower vertical stabilizer element having an upper end depending from a lower portion of said hollow tubular element, wherein during use thereof said upper and lower vertical stabilizer elements provide lateral stability and said hollow tubular element provides increased lateral stability and vertical stability for enhance control by a user.

2. The stabilizing fin of claim 1, wherein said hollow tubular element has a substantially circular cross-section.

3. The stabilizing fin of claim 1, wherein said upper vertical stabilizer element comprises a single vertically oriented plane.

4. The stabilizing fin of claim 1, wherein said upper vertical stabilizer element, said hollow tubular element and said lower vertical stabilizer element are integrally connected.

5. The stabilizing fin of claim 1, wherein said water planing device comprises a surfboard.

6. The stabilizing fin of claim 1, wherein said water planing device comprises a windsurfing board.

7. A stabilizing fin for a water planing device, comprising:

an upper vertical stabilizer element having an upper end for attachment to a bottom surface of a water planing device;

a hollow tubular element having an upper portion depending from a lower end of said upper vertical stabilizer element, said tubular element having an open front end and an open rear end, said hollow tubular element having an elliptical cross-section; and a lower vertical stabilizer element having an upper end depending from a lower portion of said hollow tubular element, wherein during use thereof said upper and lower vertical stabilizer elements provide lateral stability and said hollow tubular element provides increased lateral stability and vertical stability for enhanced control by a user.

8. A stabilizing fin for a water planing device, comprising:

an upper vertical stabilizer element having an upper end for attachment to a bottom surface of a water planing device, wherein said upper vertical stabilizer element comprises a single vertically oriented plane and includes a rounded leading edge and a tapered trailing edge;

a hollow tubular element having an upper portion depending from a lower end of said upper vertical stabilizer element, said tubular element having an open front end and an open rear end; and a lower vertical stabilizer element having an upper end depending from a lower portion of said hollow tubular element, wherein during use thereof said upper and lower vertical stabilizer elements provide lateral stability and said hollow tubular element provides increased lateral stability and vertical stability for enhanced control by a user.

9. A stabilizing fin for a water planing device, comprising:

an upper vertical stabilizer element having an upper end for attachment to a bottom surface of a water planing device, wherein said upper vertical stabilizer element comprises a single vertically oriented plane;

a hollow tubular element having an upper portion depending from a lower end of said upper vertical stabilizer element, said tubular element having an open front end and an open rear end;

and a lower vertical stabilizer element having an upper end depending from a lower portion of said hollow tubular element, wherein said lower vertical stabilizer element comprises a rounded leading edge and a tapered trailing edge which converge at a lower end thereof;

wherein during use thereof said upper and lower vertical stabilizer elements provide lateral stability and said hollow tubular element provides increased lateral stability and vertical stability for enhanced control by a user.

10. A stabilizing fin for a water planing device, comprising:

an upper vertical stabilizer element having an upper end for attachment to a bottom surface of a water planing device;

a hollow tubular element having an upper portion depending from a lower end of said upper vertical stabilizer element, said tubular element having an open front end and an open rear end; and a lower vertical stabilizer element having an upper end depending from a lower portion of said hollow tubular element, wherein during use thereof said upper and lower vertical stabilizer elements provide lateral stability and said hollow tubular element provides increased lateral stability and vertical stability for enhanced control by a user; and wherein a lower front portion of said upper vertical stabilizer element is contiguous with an upper front portion of said hollow tubular element, a lower front portion of said hollow tubular element is contiguous with an upper front portion of said lower vertical stabilizer element, a lower rear portion of said upper vertical stabilizer element is contiguous with an upper rear portion of said hollow tubular element, and a lower rear portion of said hollow tubular element is contiguous with an upper rear portion of said lower vertical stabilizer element, thereby providing a continuous curve side profile for said stabilizing fin.

* * * * *